US005395868A

United States Patent [19]

Sanduja et al.

[11] Patent Number: 5,395,868

[45] Date of Patent: Mar. 7, 1995

[54] SOLUTION FOR ANTI-CONTAMINANT COATING TREATMENT FOR PAPERMAKERS' FABRICS

[75] Inventors: Mohan L. Sanduja, Flushing; Paul Thottathil, New Hyde Park, both of N.Y.

[73] Assignee: Huyck Licensco, Inc., Wilmington, Del.

[21] Appl. No.: 10,549

[22] Filed: Jan. 28, 1993

Related U.S. Application Data

[62] Division of Ser. No. 869,945, Apr. 17, 1992, Pat. No. 5,207,873.

[51] Int. Cl.[6] ..... C08K 3/00; C08K 5/00

[52] U.S. Cl. ..... 524/104; 524/403; 524/502; 524/507; 524/516; 524/520

[58] Field of Search ..... 524/104, 507, 403, 502, 524/516, 520

[56] References Cited

U.S. PATENT DOCUMENTS

| | | | |
|---|---|---|---|
| 3,617,442 | 11/1971 | Hurschman | 162/212 |
| 3,698,931 | 10/1972 | Horowitz | 117/47 R |
| 4,206,102 | 6/1980 | Britain et al. | 524/507 |
| 4,403,700 | 9/1983 | Manlove | 211/88 |
| 5,185,386 | 2/1993 | Cohen et al. | 524/104 |

FOREIGN PATENT DOCUMENTS

| | | | |
|---|---|---|---|
| 710560 | 6/1965 | Canada | 162/503 |

*Primary Examiner*—Judy M. Reddick
*Attorney, Agent, or Firm*—Lorusso & Loud

[57] ABSTRACT

Coating solution for papermaking fabrics that includes as its primary components polytetrafluoroethylane, urethane copolymer and polyacrylamide. The coating composition is prepared in a solution, coated on the fabric and cured. A fabric thus treated has permanent anti sticking properties against pressure sensitive adhesives, pitch from wood pulp, ink deposition and the like.

3 Claims, No Drawings

SOLUTION FOR ANTI-CONTAMINANT COATING TREATMENT FOR PAPERMAKERS' FABRICS

This is a divisional of application Ser. No. 07/869,945, filed on Apr. 17, 1992, now U.S. Pat. No. 5,207,873.

BACKGROUND OF THE INVENTION

This invention relates to papermaker's fabrics and more particularly to an anti-contaminant treatment for papermaking fabrics and that imparts anti-sticking characteristics to the fabric so that contaminants are easily removed.

Papermaking fabrics for use in papermaking machines usually are in the form of a fine mesh cloth which has been woven endless or otherwise joined into an endless web.

At one time, all papermaking fabrics were manufactured from metal wires. These metal-wire cloths were useful in all kinds papermaking machines and for all paper qualities. Eventually, metal wire cloths were replaced by cloths or wires of synthetic fiber threads.

The advantage of synthetic threads beyond metal-wire threads primarily resides in their improved fatigue and wear resistance. Synthetic wires or papermaking fabrics do, however, suffer from the disadvantage of having considerably less stability than paper forming cloths made from metal-wires of corresponding coarseness.

Furthermore, with such papermaking fabrics formed of synthetic polymer materials it is desirable to provide the surfaces of the fabric with special properties to prevent the adhesion to the fabric of suspended particles present in the paper stock which would thereby reduce the drainage properties of the fabric. Adhering of such particles is an acute problem in the case where the liquid suspension, or pulp, used to make the paper contains suspended particles of filler clay, pitch (fatty acids) and/or polymer materials from repulped, deinked paper, in addition to suspended cellulose fibers. For example, a non-treated fabric installed on a corrugating machine could lose as much as 20% permeability during its useful life due to particle retention on the fabric. Similarly, there is the problem of adhesion from contaminants present in recycled paper, e.g. glue from envelopes.

In addition, with such papermaking fabrics it is desirable to provide the above mentioned special surface properties which are permanent and remain in place when the fabric has run for a few cycles on the papermaking machine. In the past, all fabrics treated to prevent adhesion lose the special surface properties from the treatment after a few cycles and therefore the problems associated with contamination from the sources described above remain a major concern in the papermaking industry.

SUMMARY OF THE INVENTION

The present invention is an anti-contaminant treatment for a papermaking fabric to impart superior anti-sticking properties permanently to the fabric and a method to make such a fabric. The treatment composition essentially includes a combination of TEFLON, urethane and polyacrylamide combined and formed into a 1% solid solution. The fabric is then run through a bath of this solution and subsequently dried to cure the coating on the fabric.

It is the object of the present invention to provide an anti-contaminant treatment for coating a papermaker's fabric to produce a fabric having anti-sticking characteristics.

It is another object of the invention to provide a method to treat a papermaking fabric so that the problem of contaminant adhesion to the fabric during the papermaking process is reduced or eliminated.

A further object of the present invention is to provide an anti-contaminant coating for a papermakers fabric which is permanent.

DETAILED DESCRIPTION OF THE PREFERRED EMBODIMENT

At the outset, the present invention is described in its broadest overall aspects with a more detailed description following. In its broadest overall aspect, the present invention is a composition that provides an anti-contaminant treatment for a papermaking fabric, to impart superior anti-sticking properties to the fabric, a papermaking fabric having these characteristics and a method to make such a fabric. The composition is primarily made up of the polymers TEFLON, urethane and polyacrylamide in specific concentrations and formed into a solution to form a treatment that is coated to papermakers' fabrics to impart permanent anti-sticking properties to the fabric.

The principal polymer used in the present invention is Teflon 35. Teflon 35, is a trademark of E. I. Dupont de Nemours, of Wilmington, Del., for polytetraflouroethylene. This imparts non-stick coating properties to the fabric. In the composition of the present invention the fluoro polymer TEFLON will make up 20–30 parts by weight of the anti-contaminant composition, and preferably will be 25 parts by weight of the total volume.

Other polymers used include urethane Neorez R-962 (Neorez is a trademark of Polyvinyl Chemical Industries, of Wilmington, Mass., 01887 for polystryrene copolymer emulsions and urethane prepolymers) and polyacrylamide, which will generally make up 20–30 and 10–15 parts by weight respectively, and preferably will be 23 and 11 parts by weight respectively of the inventive composition. The urethane acts as a protective coating and the polyacrylamide is a solid thickening agent.

The polymer acrylic Neocryl A612 (Neocryl is a trademark of Polyvinyl Chemical- Industries, of Wilmington, Mass., 01887 for acrylic polymers and copolymers) is also present in the composition of the present invention and will make up 2–4 parts by weight and preferably 3 parts by weight.

Other components used in the composition of the present invention are, as measured in parts by weight: NN methylene bisacrylamide (0.9); polyaziridine cross-linker CX-100 (0.95); methyl pyrrolidone (0.95); ammonium persulfate 10% solution (0.6); sodium metabisulfite 10% solution (0.6); urea peroxide 0.1% solution (0.6) and silver nitrate 0.1% solution (0.00062).

The remaining portion of the composition is water and in an important embodiment is 30–35 parts by weight and preferably 33 parts by weight.

According to the present invention it is possible to use the anti-contaminant treatment of the present invention on all papermaking fabrics and most preferably those made up of yarns of polyester or nylon.

The components of the present invention, as described above, are all mixed together and then diluted to a 1% solids solution. The fabric is coated by running it through a bath containing the solution until it is fully soaked. The solution transfers to the fabric yarns instantaneously due to capillary action, and then the fabric is dried by heat treatment at a temperature above the boiling point of water, and preferably between 200° F. to 400° F. to cure the coating to the fabric.

The invention is further illustrated in the following non-limiting example.

EXAMPLE

A solution was prepared by combining the following components and then diluting them to a 1% solution with water (amounts are of parts by weight of the total): water (33.7); fluro polymer TEFLON 35 (25.2); urethane prepolymer neorez R-962 (23.6); acrylic prepolymer neocryl A 612 (3.2); methyl pyrrolidone (0.95); polyaziridine cross linker CX-100 (0.95); NN methylene bisacrylamide (0.9); ammonium persulfate 10% solution (0.6); urea peroxide 0.1% solution (0.06) and silver nitrate 0.1% solution (0.00062).

A papermaking fabric produced from 0.17 mm diameter polyester monofilament yarns was run through a bath containing the solution until it was soaked. The fabric was removed from the solution and heat treated, at 240° F., to cure the solution to the fabric.

A fabric treated in this manner has significant anti-sticking properties. This has been measured by conventional laboratory tests, such as the Instron Tester, as well as by practical Use. Tests have been performed by applying sticky tape onto the surface of a fabric and then measuring the force required to peel the tape off. Untreated fabric proved to stick very hard to the tape and fabrics treated according to the present invention showed resistance to sticking. Additional tests, performed by dipping fabric into a pitch/water suspension showed that the pitch did not rinse off the untreated fabrics but did rinse off the treated fabrics. These tests all indicate the significant anti-sticking properties of the treated fabrics.

The treatment did not significantly affect the other properties of yarns or fabric. For example, the stretchability and permeability of the fabric to water are not reduced.

Additionally, the same tests run on a treated fabric after considerable lengths of time in use on the papermaking machine showed the same desirable properties, a remarkable resistance to adhesion of the tape and contaminants from the paper stock suspension. Thus, the treatment is permanent, a significant improvement over known treatments.

The foregoing invention has been described with reference to its preferred embodiments. Although variations and modifications will occur to those skilled in the art, it is intended that such variations and modifications fall within the scope of the appended claims.

What is claimed is:

1. A papermakers' fabric anti-contaminant coating solution comprising an aqueous solution of, based upon 100 parts by weight:

20–30 parts by weight polytetrafluoroethylene;
20–30 parts by weight urethane prepolymer;
10–15 parts by weight polyacrylamide;
2–4 parts by weight acrylic polymer emulsion;
0.5–1.5 parts by weight methylene bisacrylamide;
0.5–1.5 parts by weight polyaziridine crosslinker;
0.5–1.5 parts by weight methyl pyrrolidone;
0.5–1.0 parts by weight ammonium persulfate 10% aqueous solution;
0.5–1.0 parts by weight sodium metabisulfite 10% aqueous solution;
0.5–1.0 parts by weight urea peroxide 0.1% aqueous solution and
0.0005–0.001 parts by weight silver nitrate 0.1% aqueous solution.

2. The solution of claim 1 comprising:

25 parts by weight polytetrafluoroethylene;
23 parts by weight urethane prepolymer;
11 parts by weight polyacrylamide;
3 parts by weight acrylic popolymer emulsion;
0.9 parts by weight methylene bisacrylamide;
0.95 parts by weight polyaziridine crosslinker;
0.95 parts by weight methyl pyrrolidone;
0.6 parts by weight ammonium persulfate 10% aqueous solution;
0.6 parts by weight sodium metabisulfite 10% aqueous solution;
0.6 parts by weight urea peroxide 0.1% aqueous solution;
0.0006 parts by weight silver nitrate 0.1% aqueous solution;

3. The solution of claim 1 wherein the non-water components are further diluted with water to a 1% solids solution.

* * * * *

UNITED STATES PATENT AND TRADEMARK OFFICE

CERTIFICATE OF CORRECTION

PATENT NO. : 5,395,868

DATED : March 7, 1995

INVENTOR(S) : Sanduja et al.

It is certified that error appears in the above-indentified patent and that said Letters Patent is hereby corrected as shown below:

Column 4, Line 32: Delete "popolymer" and insert --polymer--.

Signed and Sealed this

Twenty-ninth Day of August, 1995

*Attest:*

Bruce Lehman

BRUCE LEHMAN

*Attesting Officer*

*Commissioner of Patents and Trademarks*